US005239230A

United States Patent [19]

Mathews et al.

[11] Patent Number: 5,239,230

[45] Date of Patent: Aug. 24, 1993

[54] HIGH BRIGHTNESS DISCHARGE LIGHT SOURCE

[75] Inventors: Paul G. Mathews; Gary R. Allen, both of Chesterland; Timothy P. Dever, Fairview Park; Rocco T. Giordano, Garfield Heights; John M. Davenport, Lyndhurst, all of Ohio

[73] Assignee: General Electric Company, Schenectady, N.Y.

[21] Appl. No.: 858,906

[22] Filed: Mar. 27, 1992

[51] Int. Cl.[5] ..... H01J 17/04; H01J 61/02

[52] U.S. Cl. ..... 313/571; 313/620

[58] Field of Search ..... 313/570, 571, 620

[56] References Cited

U.S. PATENT DOCUMENTS

| | | | |
|---|---|---|---|
| 3,619,683 | 11/1971 | Weston | 313/571 X |
| 4,198,586 | 4/1980 | de Jong et al. | 313/625 |
| 4,594,529 | 6/1986 | de Vrijer | 313/620 X |
| 5,144,201 | 9/1992 | Graham et al. | 313/620 X |

*Primary Examiner*—Sandra L. O'Shea
*Attorney, Agent, or Firm*—George E. Hawranko; Stanley C. Corwin

[57] ABSTRACT

A high brightness discharge light source includes an arctube having an arc chamber formed therein and in which is disposed a fill of gas energizable to a discharge condition. At least two electrodes extend into the arc chamber and are separated by an arc gap of between 2 and 3.5 mm. The dose of mercury disposed in the arc chamber and various arc tube dimensions are selected so as to achieve a balance between three constraints including operating voltage thereby defining lamp efficacy, convective stability and structural integrity of the discharge lamp. A balance between arc gap, arc chamber diameter, wall thickness and the mercury density of the lamp yield a discharge lamp which achieves a light output on the order of 50,000 lumens per square centimeter.

15 Claims, 5 Drawing Sheets

HIGH BRIGHTNESS DISCHARGE LIGHT SOURCE

FIELD OF THE INVENTION

This invention relates to a high intensity discharge arctube light source which exhibits a high brightness level. More particularly, this invention relates to such a discharge arctube exhibiting high brightness as may be used in conjunction with an optical fiber arrangement for transmitting the light output of the light source to a position or positions remote from the light source.

BACKGROUND OF THE INVENTION

The concept of providing a central lighting source and channeling the light output therefrom to various remote locations using optical fibers, light guides or the like has been proposed for various applications including automotive, display lighting and home lighting. An example of a central lighting scheme for an automotive application can be found in U.S. Pat. No. 4,958,263 issued to Davenport et al. on Sep. 18, 1990 which is assigned to the same assignee as the present invention. The goal of this automotive central lighting scheme as well as any other central lighting scheme, is to achieve the most efficient light output at the point of light delivery and to deliver such light output in a manner that allows for the specific lighting design considerations. For instance, in an automotive lighting design application, recent concerns have been towards improving the aerodynamic properties of the vehicle front end by reducing the space needed to accommodate forward lighting. As such, it would be advantageous if the designer could provide the necessary forward lighting using a design space on the order of approximately two inches in height. It is known however that to achieve such a design constraint and still provide the necessary illumination pattern, a small narrow beam of light is needed from the output end of the optical fiber. For example, in order to provide good illumination and beam control from a two inch high headlamp, it is necessary to utilize an optical fiber having a cross-sectional dimension of approximately 6 to 8 mm and to deliver from such optical fiber, at least 500 lumens (per headlamp) into f/1 optics. Additionally, in order to provide for the use of this small dimension optical fiber, it is necessary to provide a light source having an arc gap substantially less than the 4 mm arc gap typically used for automotive headlamps. This size limit requirement is due to the fact that when a typical elliptical reflector is used to focus the light from the arc onto the entrance face of the optical fiber, the reflector will magnify the arc gap length by a factor of between three and four times. As a side benefit of providing this controlled beam output, the designer achieves cost, size, weight and design flexibility benefits by use of the smaller diameter optical fibers.

Of further importance to the designer of lighting systems using a centralized light source and a small diameter light transmission medium to deliver light output remotely, is the fact that the brightness of the light source must be at a relatively high level. The photometric definition for brightness (more precisely, luminance) is the number of lumens per unit area per unit solid angle. The usual device for directing light from the discharge arc into the optical fiber or light guide is an elliptical reflector with the arc at one focus and the input face of the optical fibers at the second focus. In this arrangement, the brightness (luminance) at the fiber is proportional to the arc lumens divided by the gap$^2$. It is useful to define arc lumens divided by gap$^2$ as the effective brightness of the arc. For example, it has been determined experimentally that superior headlamp illumination and beam control is obtained by coupling 1000 lumens to each headlamp through an optimized optical collector and light guide at 55% efficiency, from a 2.7 mm long arc gap. The effective brightness of the arc to provide superior beam performance would therefore be:

$$\frac{1000 \text{ lumens} \times 2 \text{ headlamps}}{(.27 \text{ cm})^2 \times .55} = 50{,}000 \text{ Lm/cm}^2$$

The light source disclosed in the above-discussed centralized automotive lighting patent achieves an effective brightness so defined, on the order of 34,000 lumens per cm$^2$. This effective brightness level is accomplished by use of the discharge arctube light source described in U.S. Pat. No. 4,968,916 which issued to Davenport et al on Nov. 6, 1990 and is assigned to the same assignee as the present invention. This light source has a pressurized gas fill consisting of a metal halide, an amount of mercury in the range of between 5 and 50 mg per cubic centimeter of bulb volume and an inert gas having a pressure in the range of between 10 Torr and 15,000 Torr. U.S. Pat. No. 4,968,916 further discloses that the light source can have a cylindrical, ellipsoidal or tubular shape with the general dimensions of: a length in the range of 5 mm to about 100 mm, a central portion with a diameter of about 4 mm to 25 mm, a volumetric capacity of about 0.1 to 30 cubic centimeters and a predetermined distance, or arc gap between the electrodes of between 1 and 5 mm.

In actual practice, it is known that arc gaps for the typical metal halide discharge light source must be on the order of at least 4 mm so as to operate at advantageously high arc voltages in a sufficiently low density range to be free of convective instability. In fact, if one were to utilize an arc gap less than the typical 4 mm value for the lamp disclosed in U.S. Pat. No. 4,968,916 and still maintain an operating voltage which yields an acceptable efficacy value, it would be necessary to increase the mercury density in this lamp to a value significantly higher than this design contemplates. For a discharge lamp, mercury density, that is, the amount of mercury per volume, is an important design consideration for several reasons. By the known relationship between the operating voltage and the product of the arc gap and approximately the square root of the mercury density (see equation (1) below), it can be seen that a decrease in the arc gap below the 4 mm value typically practiced, must be accompanied by an exponential increase in the mercury density in order to maintain the necessary operating voltage. Such an increase in mercury density adversely affects other lamp operation characteristics however such as convective stability and stress on the material from which the arc tube is constructed. Of course, it is known that convective stability is dependent upon the dimensions of the arctube as well as the fill density and that to increase the fill density and the arctube diameter without limit, a risk of convective instability arises. It is a further challenge to the convective stability of the arc, and the mechanical integrity of the arc tube when a cold-fill pressure of several atmospheres of Xenon is added to provide for instant light warm-ups. Accordingly, it would be advantageous if one were to develop a discharge lamp having a shorter arc gap that achieves a high brightness level, particularly one on the order of approximately 2.5–3.0 mm with a brightness level in excess of 50,000 lumens per $cm^2$ and wherein such short arc gap discharge lamp could operate at the higher pressures without risk of failure or damage to the integrity of the arc tube in which the discharge occurs, and without the risk of convective instability that would cause flicker in the light output. Effective brightness can be plotted against the arc loading of the lamp, where arc loading is measured as the lamp power divided by the arc gap and where values typically fall in the range of between 60 and 120 watts per cm for metal halide discharge lamps. The power needed to achieve the number of lumens for this desired brightness level is determined by the efficacy of the lamp, which can be on the order of approximately 15 lumens per watt (lpw) for a xenon discharge lamp to approximately 70 or more lpw as in the present instance. At 75 lpw, to achieve 4500 lumens across a 2.7 mm arc gap, it would be necessary to operate the arc discharge at 60 watts as an example of an application of the present invention. In addition to the metal halide type of arc discharge described herein, it is known that xenon discharge lamps also provide a high brightness light output. Use of purely xenon discharge however, at approximately 15 lpw requires a significantly higher power rating to satisfy the lumens requirement and, in addition, the light output of a xenon discharge has a correlated color temperature (CCT) index of approximately 10,000° Kelvin, which is significantly higher than the desired range for headlamp or general illumination purposes.

When considering brightness levels of the discharge lamp, it would be highly advantageous to achieve the desired lumen output at as low a power rating as possible thereby conserving energy and reducing the heat generated by the light source, heat which can adversely affect the optical fiber. In one example of a light source and reflector combination for use with optical fibers wherein a 6 mm arc gap is provided, the light output achieved is approximately 33,000 lumens per $cm^2$ and is achieved using a 150 watt lamp. U.S. Pat. No. 5,016,152 issued to Awai et al on May 14, 1991 discloses such a light source disposed in an ellipsoidal reflector for focussing the light output to a focal point of the reflector. Though this patent discusses the desirability of increasing efficiency of light transfer to the optical fibers, there is no discussion of providing a light source having a high brightness level and a short arc gap thereby reducing the needed dimensions of the optical fibers.

It would be advantageous to a discharge light source having a short arc gap and high brightness output so as to be particularly suitable for use with optical fibers if such a light source exhibited long life characteristics where long life is typically considered to be on the order of 2000 hours of operation or longer. To obtain long life, it is known that a metal-halide light source must operate at a wall loading value of less than 20 watts per $cm^2$. Therefore, for a high brightness light source particularly suited for operation with a light transmission arrangement such as optical fibers, it would be a significant advantage over existing light sources to provide a discharge lamp which achieves a relatively high brightness level using an arc gap substantially less than 4 mm in length, operates at a voltage which allows for high efficacy, requires a mercury density which results in an operating pressure well within the constraints of the mechanical properties of the arc tube and, which mercury density, along with the preferred arc tube dimensions, allows operation of the light source free from convective instability and also operates at a wall loading conducive to long lamp life.

SUMMARY OF THE INVENTION

The present invention provides a high brightness light source having a short arc gap which provides the ability to operate in conjunction with a minimum diameter optical fiber or other type of light transmission medium. For central lighting systems which utilize optical fibers, overall system performance characteristics can be improved using a high brightness light source with a short arc gap which exhibits efficacy and color temperature properties consistent with other metal halide discharge lamps having longer arc gaps. The light source of the present invention provides such properties and does so at a low power rating, at an efficient operating voltage and without the risk of convective instability and damage to the arctube as a result of the operating pressure of the light source.

In accordance with the principles of the present invention, there is provided an arc discharge light source exhibiting high brightness properties which includes an arctube having an arc chamber formed therein and in which chamber is disposed a gas fill energizable to a discharge condition such gas fill including a cold fill pressure of 3–10 atmospheres of Xe to provide for instant light warm-up. At least two electrodes extend into the chamber and are separated by an arc gap of less than 4 millimeters. Upon energization and warm-up of the light source, an operating voltage having a predetermined minimum design value is developed across the electrodes. The fill disposed within the arc chamber includes a dose of mercury which, as a function of the volume of the arc chamber, determines a mercury density value. The mercury density is a factor along with the arc gap dimension, in establishing the predetermined operating voltage. The arc chamber dimensions are selected so that, in conjunction with the total fill density value, a convective stability value below a predetermined threshold is achieved. The fill density value is also determinative along with the wall thickness dimension of the arctube, in achieving an arctube tensile strength value which is suitable for light source operation at the pressure established by the energization of the gas fill. With the operating voltage being a first constraint determined as a function of the fill density, the convective stability value being a second constraint determined as a function of the fill density and the tensile strength of the arctube being a third constraint determined as a function of the fill density, the light source of the present invention achieves an effective brightness as previously defined in excess of 50,000 lumens/$cm^2$ when at least two of the above three constraints are satisfied by use of a fill density value from a specific range of such values.

BRIEF DESCRIPTION OF THE DRAWINGS

In the following detailed description, reference will be made to the attached drawings in which.

DETAILED DESCRIPTION OF THE INVENTION

Figure 1:
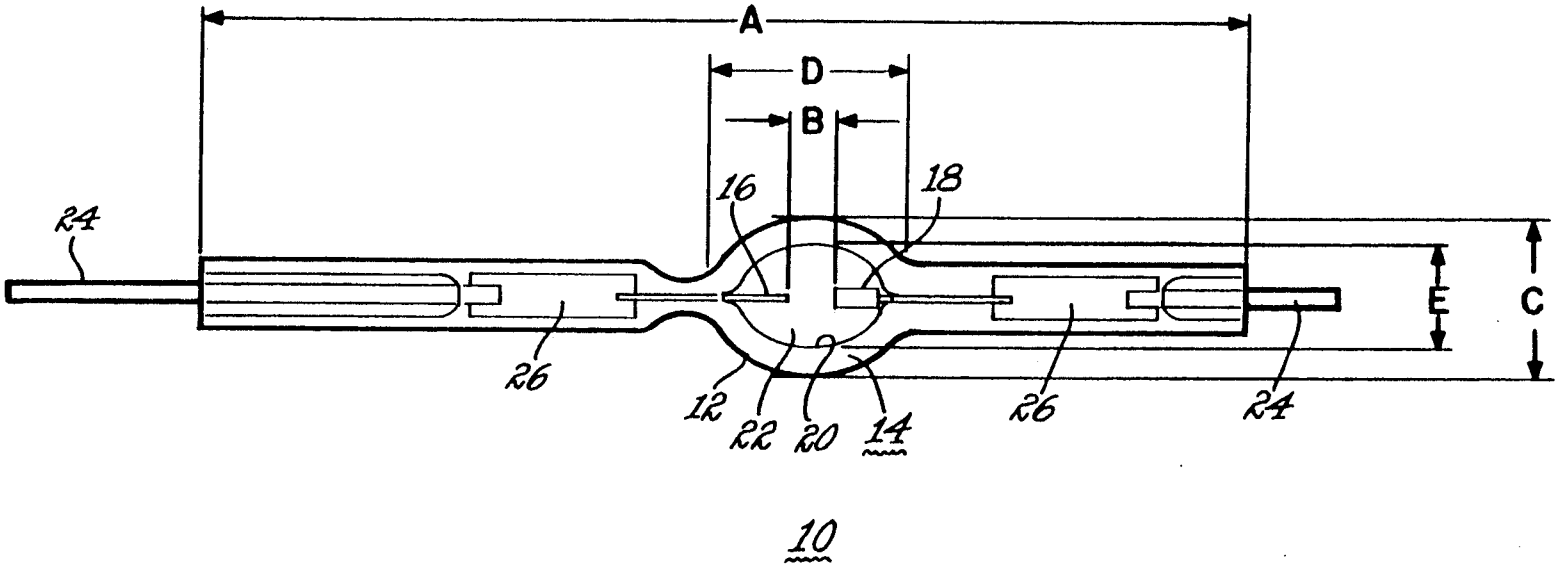
FIG. 1 is an elevational view in section of an arc discharge light source with high brightness properties constructed in accordance with the present invention.

As seen in FIG. 1, the high brightness arc discharge lamp 10 of the present invention is provided using an arctube 12 which can be constructed of fused silica quartz material. The length of arctube 12 is designated by size reference A and can be of value in the range of between 40 and 100 mm. Arctube 12 is a double ended arctube having an ellipsoidally shaped center portion 14 and electrodes 16 and 18 extending from either end into an arc chamber 20 formed within the ellipsoidally shaped center portion 14. Of course, it can be appreciated that the high brightness properties of the present invention can be achieved by use of a single ended arctube as well and it is intended that such single ended arctube is also within the scope of the present invention. Power is connected to the electrodes over conventional inlead wires 24 with intervening molybdenum foil members 26 disposed between the inlead wires 24 and the respective electrodes 16, 18.

The distance between the electrodes 16, 18; that is, the arc gap 22, is designated by size reference B and will be on the order of less than 4 mm in length. In the preferred embodiment however, this dimension is established as being approximately 2.5–3.0 mm so that, by such short arc dimension, the image of the light output which is received by the input end of an optical fiber coupling device (not shown) can be of a small dimension which allows for the use of smaller diameter optical fibers for light distribution. It is known that for an arc discharge light source, to increase the level of effective brightness, a term hereinbefore defined as lumens per arc gap squared, it is necessary to decrease the length B of the arc gap 22. Decreasing the length B of the arc gap 22 has the further effect that the operating voltage of the arc discharge is decreased approximately in proportion to the length B and by a value proportional to the square root of the mercury density of the gas fill disposed in the arc chamber 20, a factor that will be described hereinafter in further detail.

Disposed within arc chamber 20 is a gas fill consisting essentially of a mixture of mercury, an amount of an inert gas such as argon, krypton or xenon and a metal halide ingredient. The preferred embodiment includes an amount of xenon gas with a fill pressure at room temperature of between 1 and 15 atmospheres which is utilized to provide a light output substantially instantaneously upon energization of the light source 10. Of course, if a lamp designer were to forego the provision of instant light and provide a gas fill which included an additional amount of mercury in place of xenon, such an embodiment could provide an arc gap of less than 2.0 mm but, by practicing the convective stability, physical stress and operating voltage characteristics of the present invention as will be described hereinafter in detail, such alternate design would still be within the scope of the present invention. The principle ingredient, the mercury dose disposed within the arc chamber 22, is responsible for establishing the mercury density of the gas fill, such mercury density typically being measured as milligrams per cubic centimeter of volume of the arc chamber 20. Selection of the mercury density determines several critical factors relating to the operation of the high brightness discharge lamp 10 of the present invention. For instance, given that the arc gap 22 is preferred to be on the order of 2.5 mm, the operating voltage (Vop) is thereby derived by the following empirical equation:

$$Vop = 21 + 1.8(\text{mercury density})^{0.56} \text{X gap} \quad . \tag{1}$$

In addition to determining the operating voltage, mercury density also determines the mercury pressure within the arctube 12 according to:

$$P(Hg) = 1.0\text{atm}/(mg/cc) \text{ X mercury density} \tag{2}$$

In addition to the dose of mercury, a fill of 6 atmospheres (at 20C) of xenon is added to the lamp 10. The xenon fill contributes a gas density of approximately 33 mg/cc and an operating pressure P(Xe) of 42 atmospheres.

Figure 3:
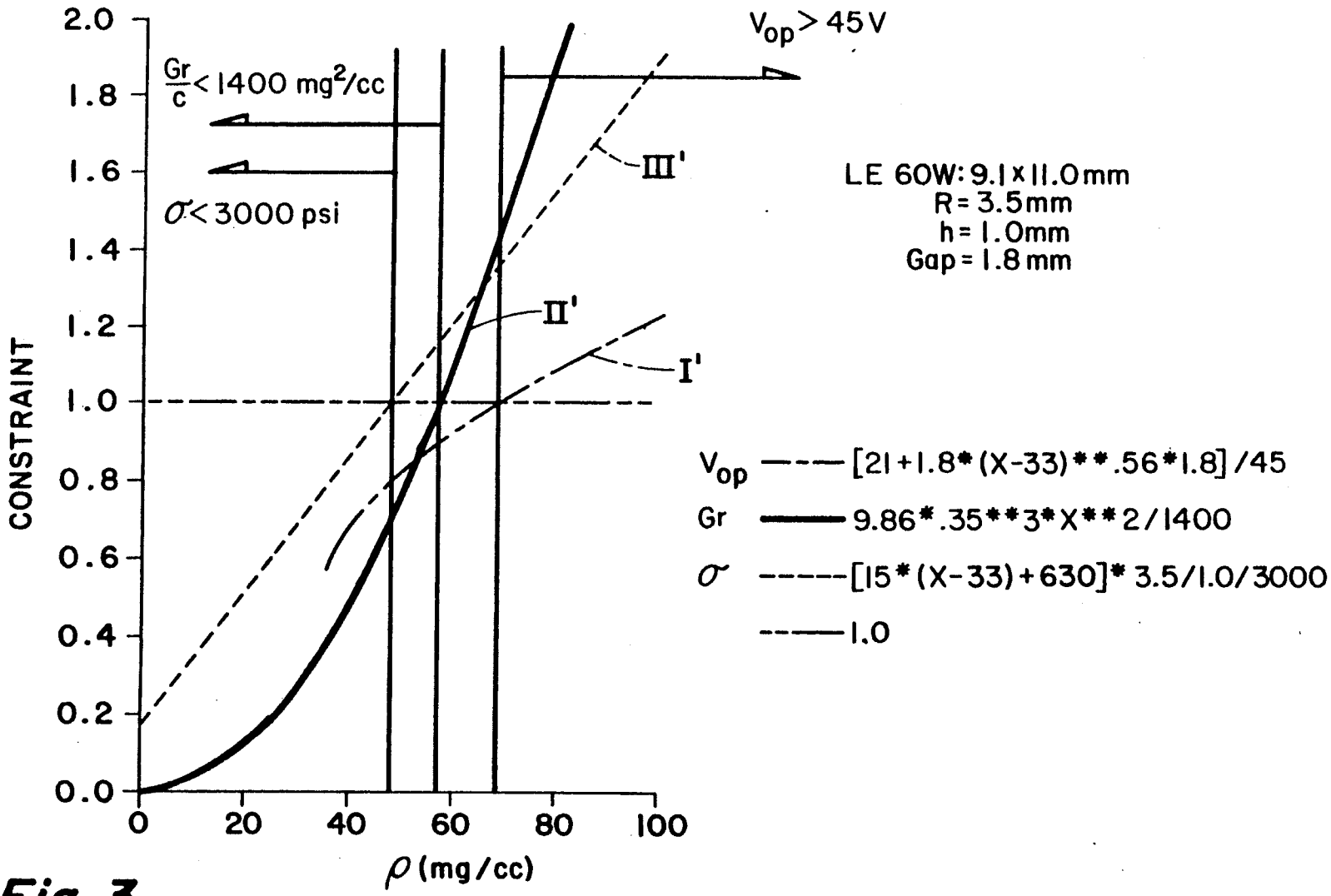
FIG. 3 is a graphical representation of the solution of the three constraints versus total density including 6 atm cold-fill Xe (33 mg/cc) for arctube dimensions which satisfies one embodiment of the present invention.

The operating voltage Vop previously discussed in relation to equation (1) is then utilized in the determination of the efficacy value at which the discharge lamp operates. The efficacy value is expressed in terms of lumens per watt (lpw) and is determined by the following empirical equation:

$$LPW \alpha 1 - \exp\left(\frac{-(Vop - 15)}{13.6}\right) \tag{3}$$

where 15 volts is attributable to electrode fall which, since electrode power does not generate light, should be minimized so that maximum efficacy can be achieved. In meeting the needs of the present invention, it has been found that for the preferred arc gap 22 of approximately 2.5 mm, it is necessary to dose the arc tube 12 with approximately 4.0 mg of mercury to yield the proper value of mercury density that results in an operating voltage of greater than 45 volts and an efficacy value of approximately 70–75 lpw. A plot of the operating voltage versus total density for a high brightness discharge lamp 10 with an arc gap 22 of approximately 2.5 mm and a cold-fill Xe pressure of 6 atm is shown by Curve I in FIGS. 4 and 5 wherein it is shown that for a total fill density value of greater than approximately 50 mg/cc of arc chamber 20 volume corresponding to a Hg fill density of 17 mg/cc, the condition of the operating voltage being in excess of 45 volts is met. Conversely, FIG. 3 illustrates an arc gap of approximately 1.8 mm that only achieves the necessary operating voltage of 45 volts when the total fill density is on the order of 70 mg/cc which includes the cold-fill of 6 atm of xenon corresponding to 37 mg/cc of Hg fill density. This operating voltage is shown as Curve I' in FIG. 3 and, as will be discussed later in more detail, results in other conditions detrimental to the operation of the lamp.

Having determined the operating voltage as a function of the mercury density and the efficacy as a function of the operating voltage, it is necessary to determine the operating energy needed to achieve the desired lumen output. Since the value of 4500 lumens for the 2.5 mm arc gap is the desired light output and the efficacy is on the order of approximately 75 lpw, the necessary power rating of the high brightness discharge lamp 10 is approximately 60 watts.

A further consideration in the development of the high brightness light source 10 of the present invention is the ability of the lamp 10 to exhibit long life characteristics, where long life is typically considered to be >2000 hours of operating life. It is known that arctube design requires that the arctube 12 wall loading, given by the lamp power divided by the arctube external surface area must be less than approximately 20 $W/cm^2$. Accordingly, since the high brightness discharge lamp 10 operates at approximately 60 watts, it is necessary to provide a surface area of at least 3.0 $cm^2$. Though there are a number of various configurations that could yield a lamp having such a surface area value, the present invention provides for an arctube 12 which is approximately 9.1 mm in outside bulb diameter shown by dimension C in FIG. 1 and 11.0 mm in bulb length shown by dimension D in FIG. 1 and further wherein the shape of the arctube 12 is ellipsoidal. It is contemplated that the various arctube configurations other than the ellipsoidal configuration shown in FIG. 1 that achieve a surface area of at least 3.0 $cm^2$ are within the scope of the present invention.

Figure 4:
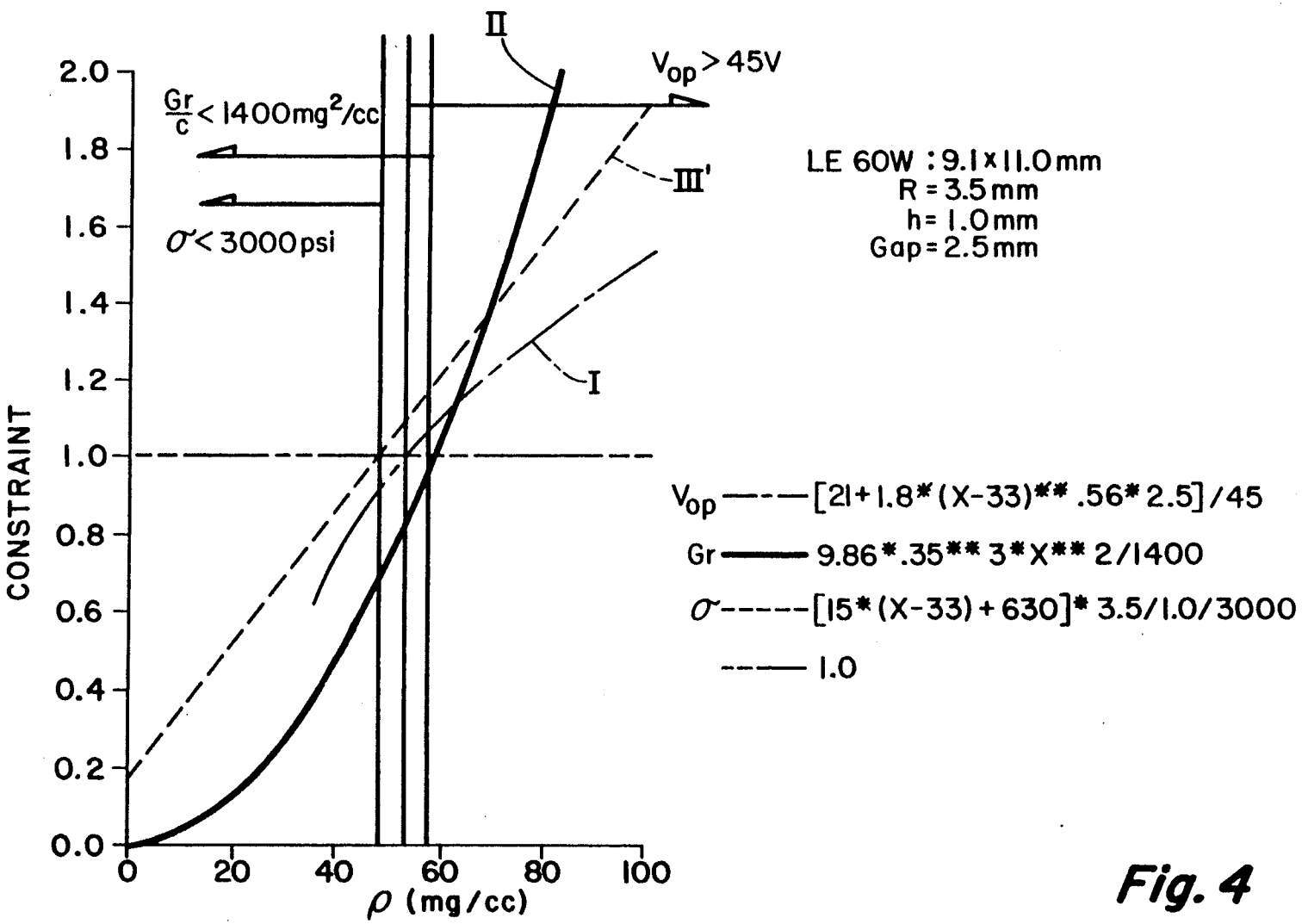
FIG. 4 is a graphical representation of an alternate solution of the three constraints versus total density using arctube dimensions which fails to satisfy the requirements of the present invention.
Figure 5:
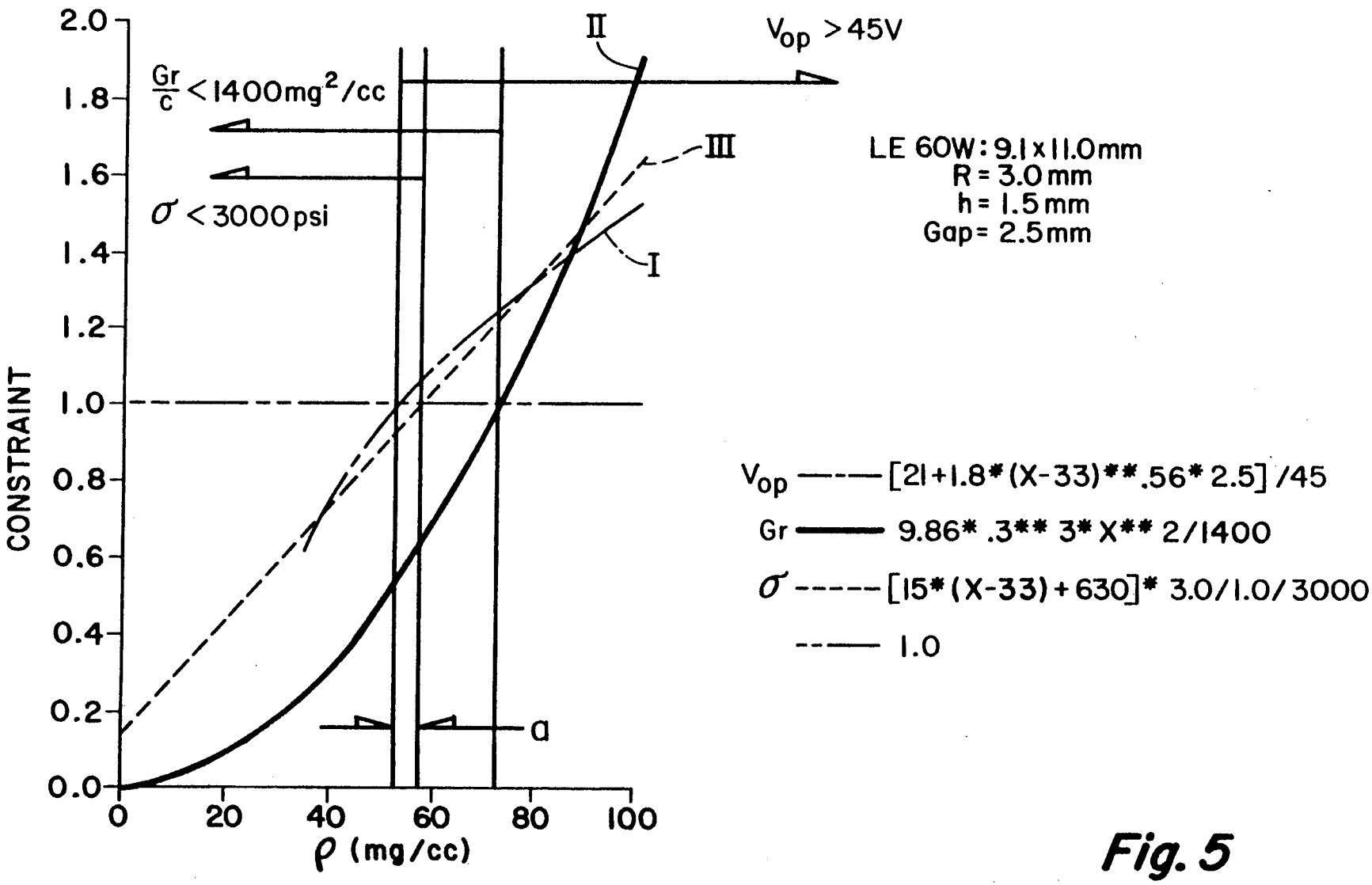
FIG. 5 is a graphical representation of the preferred solution of the three constraints versus total density using arctube dimensions which satisfies the preferred embodiment of the present invention.

In addition to the surface area dimension and the dimension of the arc gap 20, FIG. 1 also illustrates a dimension E which is the inside bulb diameter of the arc chamber 22 and a dimension h representing the thickness of the arctube 12 wall which is determined by subtracting the chamber 22 inside bulb diameter dimension E from the arctube 12 outside bulb diameter C and dividing by 2. These dimensions, along with the values of the mercury density and xenon density previously discussed, provide the parameters for determining two additional constraints plotted on FIGS. 3 through 5. Along with the operating voltage constraint previously discussed as Curve I of FIGS. 4 and 5, a second constraint that varies as a function of the value of the fill density is a value which indicates the condition of convective stability of the arc discharge. For convective stability to exist, the Grashof number, given by the following equation:

$$Gr = C \times \pi^2 \times R^3 \times (\text{mercury density} + \text{xenon density})^2 \quad (4)$$

where R is ½ the bore diameter (dimension E of FIG. 1) and c is a proportionality constant, must be below a predetermined critical value. Through experimentation, it has been found that the value Gr/c must be less than 1400 $mg^2/cc$ in order to insure that the lamp 10 operates in a convectively stable manner. If one were to solve for the Grashof number strictly as a function of the arc chamber 22 diameter and the fill density, the graphical representation of the solution to equation 4 could be obtained. Referring to the graphical representations in FIGS. 3 and 4 for the Grashof number given a chamber diameter of 7 mm, such number falls below the threshold critical value when the total fill density is less than approximately 57 mg/cc. The solution to the reduced version of eq. 4 yields Curve II' as seen in FIGS. 3 and 4 which, when compared to Curve I or I' of FIGS. 3 and 4, indicates that there is not a single solution for total fill density that would satisfy the operating voltage constraint and the convective stability constraint simultaneously. Referring to FIG. 5 however, it can be seen that with an arc chamber 22 diameter of 6.0 mm, a solution to eq. 4 for the Grashof number yields Curve II where, for a total fill density value of less than approximately 72 mg/cc, convective stability can be maintained. Additionally, it can be seen in FIG. 5 that for a range of total fill density values between approximately 52 and 72 mg/cc, both the operating voltage and convective stability constraints are satisfied simultaneously.

A third constraint is determined by the total fill density value, the arctube inside diameter, and the "h" dimension of the arctube 12, such constraint being characterized as the structural integrity constraint. For the structural integrity of the arctube 12 to be maintained; that is, to operate free from risk of a non-passive failure, it is necessary that the tensile stress of the arctube 12 material at the equator of the arctube 12 not exceed the capability of such material which, in the present instance is quartz. The tensile stress of the arctube 12 is given by the following equation:

$$\sigma = (P(Hg) + P(Xe)) \times R/h \quad (5)$$

where h is the arctube wall thickness value previously discussed, R is the arctube inside radius, and the solution to this equation must be less than the tensile strength of quartz which is on the order of approximately 7000 psi and P(Hg)+P (Xe) represents the operating pressure of the lamp. Given that the lamp 10 should have a safety factor of between two and three, it has been determined that a value less than 3000 psi would be appropriate for the solution to equation 5. It can be appreciated however that this safety factor is somewhat arbitrary and that if the lamp designer elected to relax this standard to a value below 2, the range of fill density that would satisfy all three constraints in the manner shown in FIG. 5 would be expanded in the upper range limit and that such expanded range (theoretically to the limits of Curve II—75 mg/cc) is within the scope of the present invention. Also, in the event that a material other than quartz were utilized for the arctube 12, the tensile strength and safety factor considerations could be adjusted accordingly and still practice the present invention. Solving equation 5 in terms of fill density yields the equation shown on FIGS. 3 through 5 and from which Curves III' from FIGS. 3 and 4 and Curve III from FIG. 5 are derived. Referring to FIGS. 3 and 4, it can be seen that for a wall thickness value of 1.0 mm, the values for fill density that satisfy the third constraint occur at values less than 50 mg/cc which, when compared to the solutions of the operating voltage and convective stability constraints indicates that there is no solution of fill density at which all three constraints can be satisfied simultaneously.

Referring to FIG. 5 in which a value of 1.5 mm has been selected for the wall thickness of the arctube 12, it can be seen that there is a range of values for the fill density for which all three constraints can be satisfied simultaneously, such range falling between approximately 55 and 58 mg/cc of fill density. By this graphical representation, it can be seen that for fill density values falling within this range, a high brightness discharge lamp 10 can be provided having a 2.5 mm arc gap, an arc chamber 22 radius of 3.0 mm and a wall thickness of 1.5 mm which allows for the operation of the lamp 10: at an operating voltage which results in an acceptable efficacy rating; under conditions free from convective instability; and, at a pressure which has a suitable safety factor thus insuring the structural integrity of the arctube 12.

Although FIG. 5 indicates the design parameters under which the high brightness discharge lamp 10 of the present invention exhibits the most efficient operation, it can be appreciated that there are trade-offs possible in the lamp construction that would yield a high brightness discharge lamp with a short arc gap that may not fall within the range shown in FIG. 5 but nevertheless, would result in a lamp exhibiting significantly improved brightness characteristics over existing light sources used for optical fiber light transmission systems. For instance, it would be possible to construct a light source in accordance with the values set forth in FIG. 4 wherein the fill density value were selected so as to satisfy the convective stability constraint and the tensile strength constraint simultaneously with the operating voltage constraint thereby falling outside the preferred range. In this manner, the resulting discharge lamp would still exhibit the high brightness over the short arc gap but would have an efficacy rating lower than that shown in FIG. 5 thereby necessitating the need for a higher power rating and the resultant wall loading recalculation to obtain the long life characteristics. Additionally, the previously discussed relaxation of the safety factor would yield a high brightness lamp at a range of fill values outside of the preferred range and yet achieve the other benefits of the present invention.

The following Tables 1 and 2 illustrates a comparison of characteristics of various types of discharge light sources including the high brightness discharge lamp 10 designated LE of the present invention:

TABLE 1

| Lamp | $V_{op}$ | Gap | Gr/c | $\sigma$ |
|---|---|---|---|---|
| MXR32 | 90 V | 5.0 mm | 500 $\frac{mg2}{cc}$ | 2800 psi |
| DFL | 45 | 2.2 | 330 | 1700 |
| D1 | 90 | 4.0 | 140 | 1100 |
| LE | 60 | 2.7 | 780 | 1900 |

TABLE 2

| Lamp | R | h | Vol | $\rho_{xe}$ | $\rho_{hg}$ |
|---|---|---|---|---|---|
| MXR32 | 3.9 mm | .6 mm | .175 | 0 $\frac{mg}{cc}$ | 29 $\frac{mg}{cc}$ |
| DFL | 2.2 | 1.3 | .08 | 33 | 23 |
| D1 | 1.5 | 1.5 | .035 | 33 | 31 |
| LE | 3.0 | 1.5 | .19 | 33 | 21 |

Figure 2:
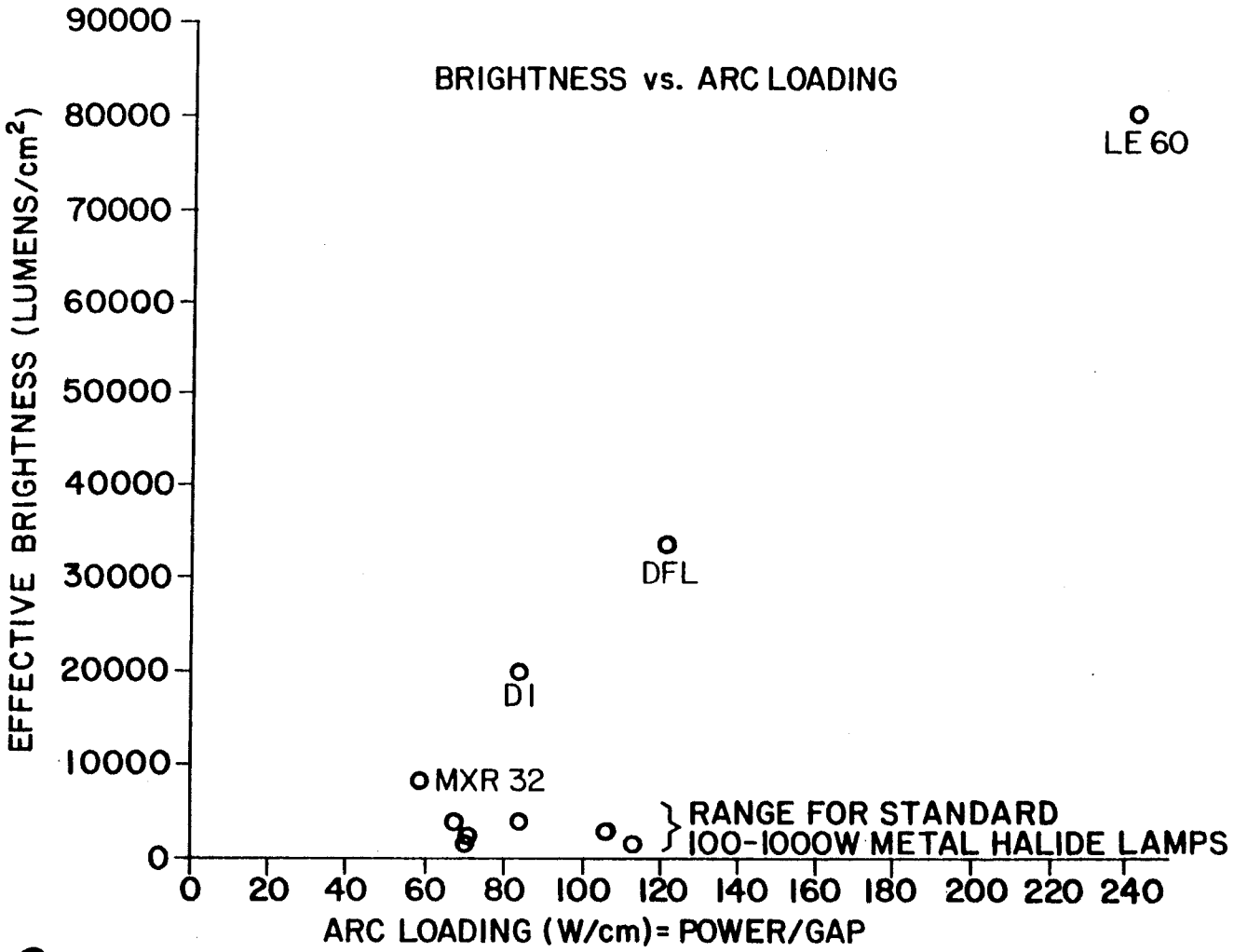
FIG. 2 is a graphical representation of the effective brightness versus arc loading properties of various known light sources as compared to the arc discharge light source of the present invention.

As previously discussed, the brightness levels attainable by the discharge lamp 10 must be high so as to provide sufficient light output for use with optical fiber or similar light transmission mediums. As seen in FIG. 2, the effective brightness characteristic measured in terms of lumens per square centimeter for discharge lamp 10 is approximately 58,000 lumens per square centimeter as compared to the output levels of the various light sources characterized in the previous Table 1. As seen in FIG. 2, standard metal-halide lamps are at least 10 times lower than the target of 50,000 Lm/cm$^2$, and even the discharge headlamps arctube designated D1 is 3.4 times too low. Even the light source designated the DFL in FIG. 2 and which is described in previously referenced U.S. Pat. No. 4,868,458 does not achieve the effective brightness of the present invention.

Although the hereinabove disclosed embodiment of the invention constitutes the preferred embodiment, it should be understood that modifications can be made thereto without departing from the scope of the invention as set forth in the appended claims.

We claim:

1. An arc discharge light source exhibiting high brightness properties comprising:

an arctube having an arc chamber formed therein;

a fill disposed in said arc chamber and energizable to a discharge condition;

at least two electrodes extending into said arc chamber and being separated by an arc gap of less than 4 mm and wherein, upon energization of said light source, an operating voltage having a predetermined minimum value is developed across said at least two electrodes;

said fill includes a dose of mercury which, as a function of the volume of said arc chamber, is determinative of a fill density value thereby, said predetermined minimum value of said operating voltage being determined as a function of said fill density and said arc gap;

said arc chamber having a size dimension selected so that, in association with said fill density, a stability value below a predetermined threshold value is achieved and further wherein said arctube has a strength value determined as a function of a wall thickness value of said arctube and said fill density; and, wherein said operating voltage is a first constraint determined as a function of said fill density, said stability value is a second constraint determined as a function of said fill density and said arctube strength value is a third constraint determined as a function of said fill density and wherein said light source achieves a brightness level in excess of 50,000 lumens per centimeter squared of arc gap unit area when at least two of said first, second and third constraints are simultaneously satisfied by any one fill density value taken from a predetermined range of mercury density values.

2. An arc discharge light source as set forth in claim 1 wherein said fill includes an amount of an inert gas, said inert gas and said mercury contributing respective density values to said overall fill density.

3. An arc discharge light source as set forth in claim 1 wherein said at least two constraints satisfied simultaneously are said convective stability constraint and said strength value constraint.

4. An arc discharge light source as set forth in claim 1 wherein all three of said constraints are satisfied simultaneously by use of a fill density value selected from the range of values between 50 mg/cc and 60 mg/cc.

5. An arc discharge light source as set forth in claim 1 wherein said convective stability constraint is calculated to fall below a predetermined threshold value determined as a function of said fill density and an arc chamber diameter dimension.

6. An arc discharge light source as set forth in claim 1 wherein said arc gap is selected as having a value between 2 mm and 3.5 mm in length.

7. An arc discharge light source as set forth in claim 1 wherein said arctube is constructed of quartz and has a tensile strength associated therewith which is determined as a function of said arctube wall thickness, said strength value constraint being determined so as to allow a safety factor of at least two times between the operating pressure of said arc discharge light source and the maximum the tensile strength capability of said arc tube.

8. An arc discharge light source as set forth in claim 1 wherein said constraints are satisfied simultaneously by balancing arctube dimension values which include said wall thickness, a diameter dimension of said arc chamber, and said arc gap which is formed between said electrodes disposed in said arctube, said arctube dimension values being balanced in a manner so as to provide a minimum arc gap, a maximum wall thickness, and a minimum arc chamber diameter dimension.

9. An arc discharge light source as set forth in claim 8 wherein said arctube dimension values are balanced while achieving a maximum arc tube surface area so as to achieve a wall loading factor of no greater than 20 watts per centimeter squared of arctube surface area.

10. An arc discharge light source as set forth in claim 1 wherein said operating voltage constraint is at least 45 volts and said arc discharge light source achieves an efficacy rating of approximately 75 lumens per watt as a result thereof.

11. An arc discharge light source as set forth in claim 1 wherein said convective stability constraint is a value less than 1400 milligrams squared per cubic centimeter.

12. An arc discharge light source as set forth in claim 9 wherein said arctube has a surface area of approximately 3.0 square centimeters and said arc discharge light source operates at approximately 60 watts of power.

13. An arc discharge light source as set forth in claim 9 wherein said arc gap is between 2.0 and 3.5 mm, said wall thickness is between 1.3 and 1.7 mm, said operating voltage is between 55 and 65 volts and said fill includes between 4 and 8 atmospheres of xenon at room temperature.

14. An arc discharge light source as set forth in claim 9 wherein said strength value constraint is determined so as to achieve a safety factor of between 1.5 and 2 times between the operating pressure of said arc discharge light source and the maximum tensile strength capability of said arc tube.

15. An arc discharge light source as set forth in claim 14 wherein all three of said constraints are satisfied simultaneously by use of a fill density value selected from the range of values between 50 mg/cc and 70 mg/cc.

* * * * *